US005274892A

United States Patent [19]

Strahm

[11] Patent Number: 5,274,892

[45] Date of Patent: Jan. 4, 1994

[54] PROCESS AND APPARATUS FOR SHRINKING TEXTILE FABRICS

[75] Inventor: Christian Strahm, Bronschhofen, Switzerland

[73] Assignee: Solipat AG, Zug, Switzerland

[21] Appl. No.: 947,586

[22] Filed: Sep. 21, 1992

[30] Foreign Application Priority Data

Sep. 21, 1991 [CH] Switzerland ..... 2805/91

[51] Int. Cl.[5] ..... D06C 23/04; D06C 17/00; F26B 21/06

[52] U.S. Cl. ..... 26/20; 26/18.5; 34/156; 34/191

[58] Field of Search ..... 26/18.5, 18.6, 19, 20; 34/22, 23, 24, 151, 152, 156, 159, 161; 68/20

[56] References Cited

U.S. PATENT DOCUMENTS

| | | | |
|---|---|---|---|
| 4,422,308 | 12/1983 | Pfeiffer et al. | 26/20 X |
| 4,677,717 | 7/1987 | Magin | 34/191 X |
| 4,679,333 | 7/1987 | Vinas | 34/191 X |
| 4,974,341 | 12/1990 | Vinas | 34/156 |
| 5,014.525 | 5/1991 | Bene | 34/156 X |
| 5,072,491 | 12/1991 | Pinto et al. | 19/105 X |

FOREIGN PATENT DOCUMENTS 346041 12/1989 European Pat. Off. ..... 34/151

*Primary Examiner*—Clifford D. Crowder
*Assistant Examiner*—John J. Calvert
*Attorney, Agent, or Firm*—Stanley P. Fisher

[57] ABSTRACT

A device for the continuous and tension free treatment of textile sheets is provided. The device comprises an air-permeable endlessly circulating material web bearing surface; an upper stationary and air permeable delimiting wall, the material web bearing surface and the delimiting wall defining a transport channel; at least one upper blower nozzle, the blower nozzle orientated downwardly and running transversely with respect to the direction of the material web bearing surface; at least one lower blower nozzle arranged in a direction in which the material web is moved the lower nozzle offset with respect to said upper blower nozzle; and the upper and lower blower nozzles arranged with respect to each other to very abruptly alternate the movement of the material web, up and down and to contactlessly support the material web above the material web bearing surface while in the transport channel. Additionally, a method of treating the textile sheets is also provided.

33 Claims, 3 Drawing Sheets

PROCESS AND APPARATUS FOR SHRINKING TEXTILE FABRICS

The invention relates to a process for continuously shrinking textile fabrics and to an apparatus for carrying out this process.

In finishing textiles, in particular plush and towelling, it is often desirable to obtain a material which has an even smaller residual shrinkage potential.

The object of the present invention is in particular to provide a method by means of which this can be achieved.

The method comprises the steps of placing a material web, in a loose state, onto an endlessly circulating material web bearing surface; advancing the material web abruptly by a first and second blower nozzles, the first blower nozzle blowing the material web toward said material web bearing surface, the second blower nozzle blowing the material web away from the material web bearing surface and towards an air-permeable material web compression surface, the material web bearing surface and the web compression surface defining a transport channel in which the material web is advanced; and drying the material web in the transport channel by very abruptly alternating the movement of the material web, up and down, by the first and second blower nozzles by contactlessly supporting the material web above the material web bearing surface while in the transport channel.

The invention further has as its subject an apparatus for carrying out the process according to the invention. The apparatus comprises an air-permeable endlessly circulating material web bearing surface; an upper stationary and air permeable delimiting wall, the material web bearing surface and the delimiting wall defining a transport channel; at lest one upper blower nozzle, the blower nozzle orientated downwardly and running transversely with respect to the direction of the material web bearing surface; at least one lower blower nozzle arranged in a direction in which the material web is moved the lower nozzle offset with respect to said upper blower nozzle; and the upper and lower blower nozzles arranged with respect to each other to very abruptly alternate the movement of the material web, up and down and to contactlessly support the material web above the material web bearing surface while in the transport channel.

The invention is explained below by way of example with reference to the drawing, in which.

Figure 1:
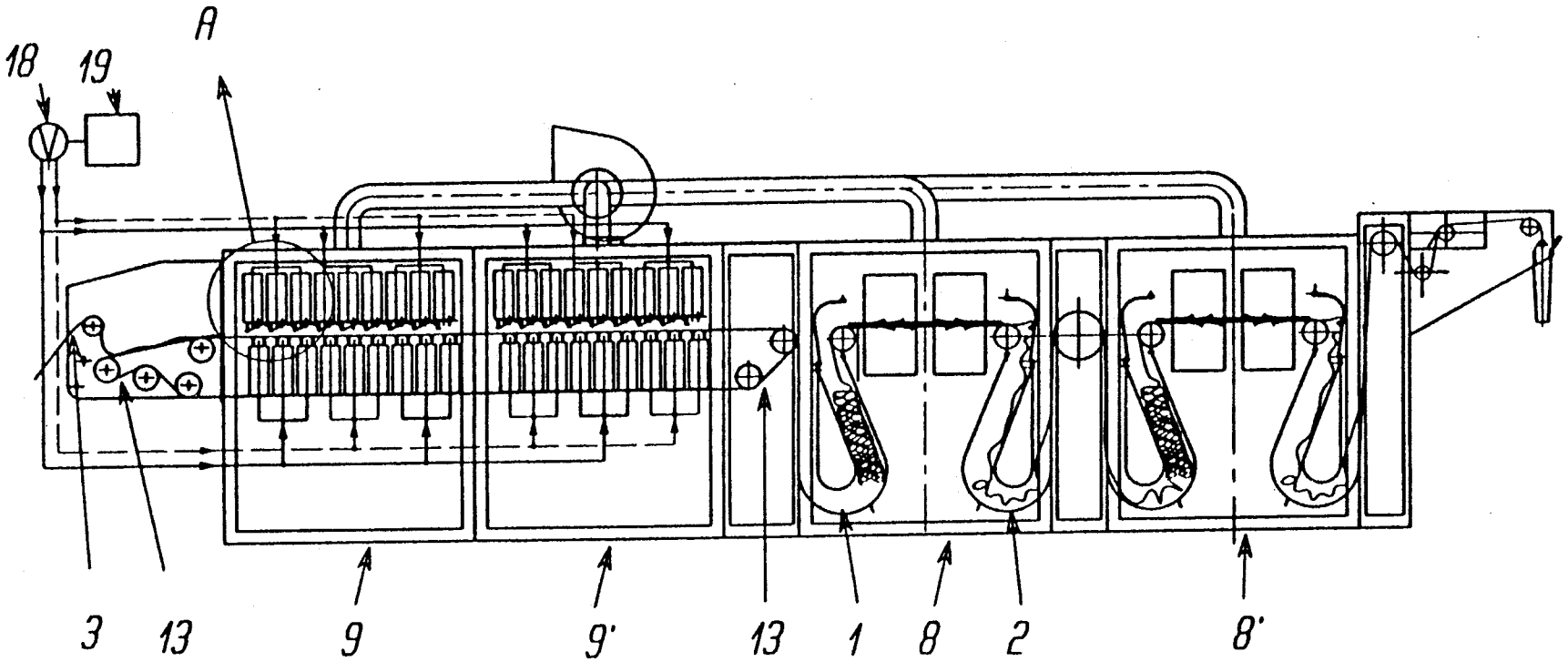
FIG. 1 shows a longitudinal section through an example embodiment of an apparatus according to the invention.
Figure 2:
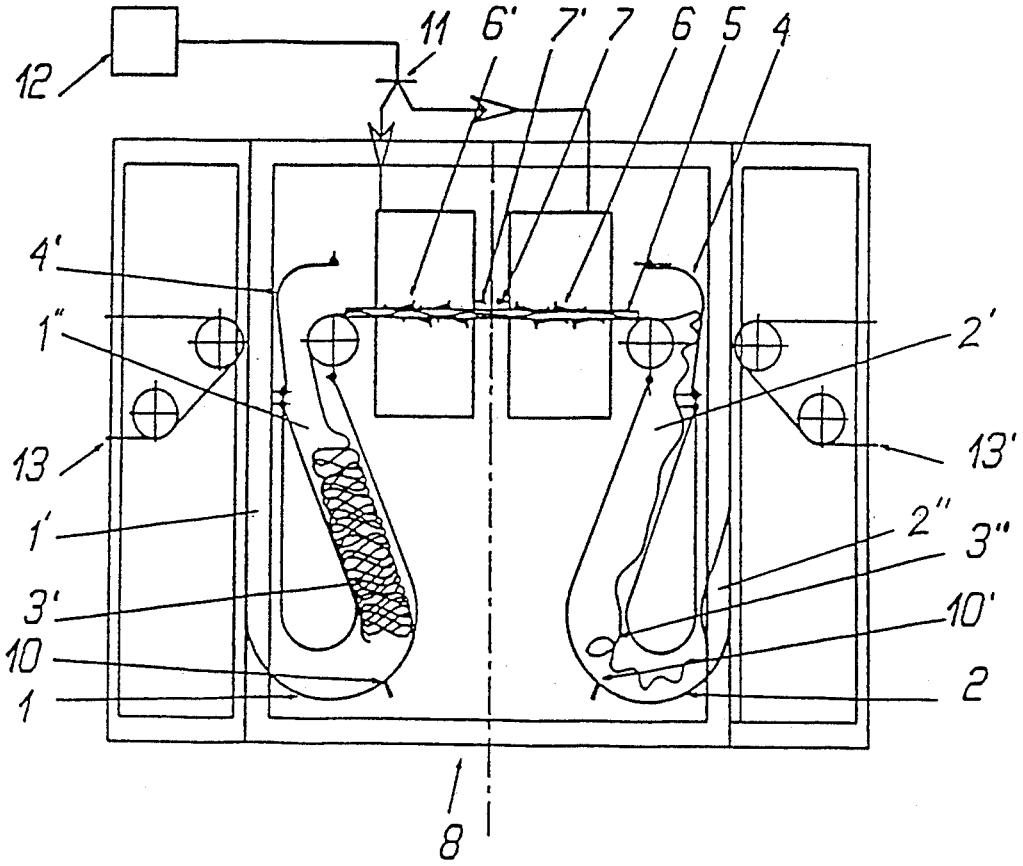
FIG. 2 shows a component of the apparatus illustrated in FIG. 1, on an enlarged scale.

As can be seen in particular from FIGS. 1 and 2, the apparatus illustrated has, downstream of the two shrink-driers 9, 9', two approximately U-shaped material web stores 1 and 2 for loosely receiving a respective material web section 3' and 3'', and a material web guidance and acceleration channel 5 which is arranged between these two material web stores 1, 2, connects them to one another and is delimited in its longitudinal direction at its two end sides by a respective material web impact surface 4 and 4'.

Pneumatic conveying means 6 and 6' which are connected to the material web guidance and acceleration channel 5 and can be brought into effect in a manner such that they can be changed over in the two mutually opposed longitudinal directions of the material web guidance and acceleration channel 5 serve to alternately convey a material web section of the material web 3 to be treated in the mutually opposed longitudinal directions 7, 7' (FIG. 3) of the guidance and acceleration channel 5 against the respectively end-side material web impact surface 4 and 4' respectively, and from there to the respectively associated material web store 2 or 1 arranged below the latter.

This component 8 can also be omitted, or, as in the embodiment illustrated, combined for example with two entry-side shrink-driers 9 and 9', this last at the same time serving as a supply arrangement 9' for continuously supplying the material web 3 to be treated to the first material web store 1.

For controlling the direction of conveying of the pneumatic conveying means 6, 6', there are provided in the lower bent regions of the two material web stores 1 and 2 optical sensor means 10 and 10' in order to sense the level of filling of the two material web stores 1 and 2 with part sections 3' and 3'' of the material web 3 to be treated.

Figure 3:
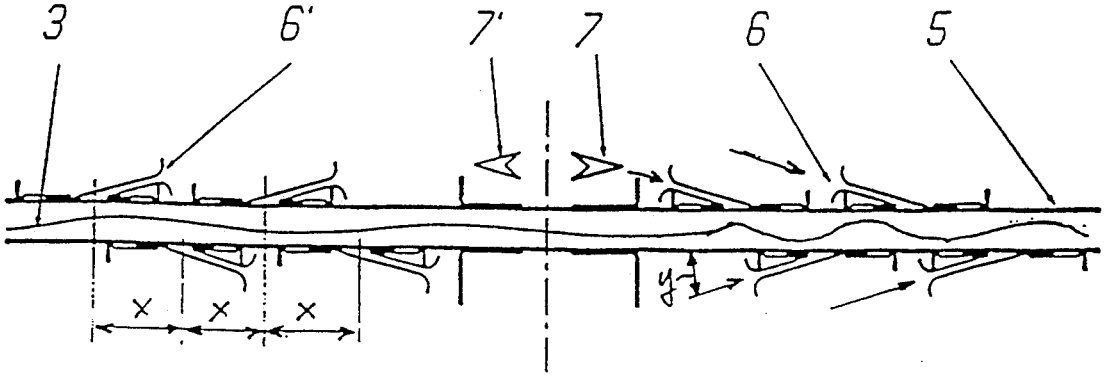
FIG. 3 shows a longitudinal section through the guidance and acceleration channel of the component illustrated in FIG. 2, on an enlarged scale.

To obtain the mutually opposed directions of conveying of the material 3 to be treated, the pneumatic conveying means associated with the acceleration channel 5 are divided, as can be seen in particular from FIG. 3, into two pneumatic conveying means groups (blower nozzles) 6 and 6' acting in mutually opposed directions of the acceleration channel 5. These two blower nozzle groups 6 and 6' are connected, alternating separately from one another, to a compressed-air source 12 e.g. by way of a flip-flop changeover element 11 (see FIG. 2) operating in accordance with the Coanda effect principle. The air used here can have a temperature in the range of for example approximately 80° to 200° C., depending on the material.

Figure 4:
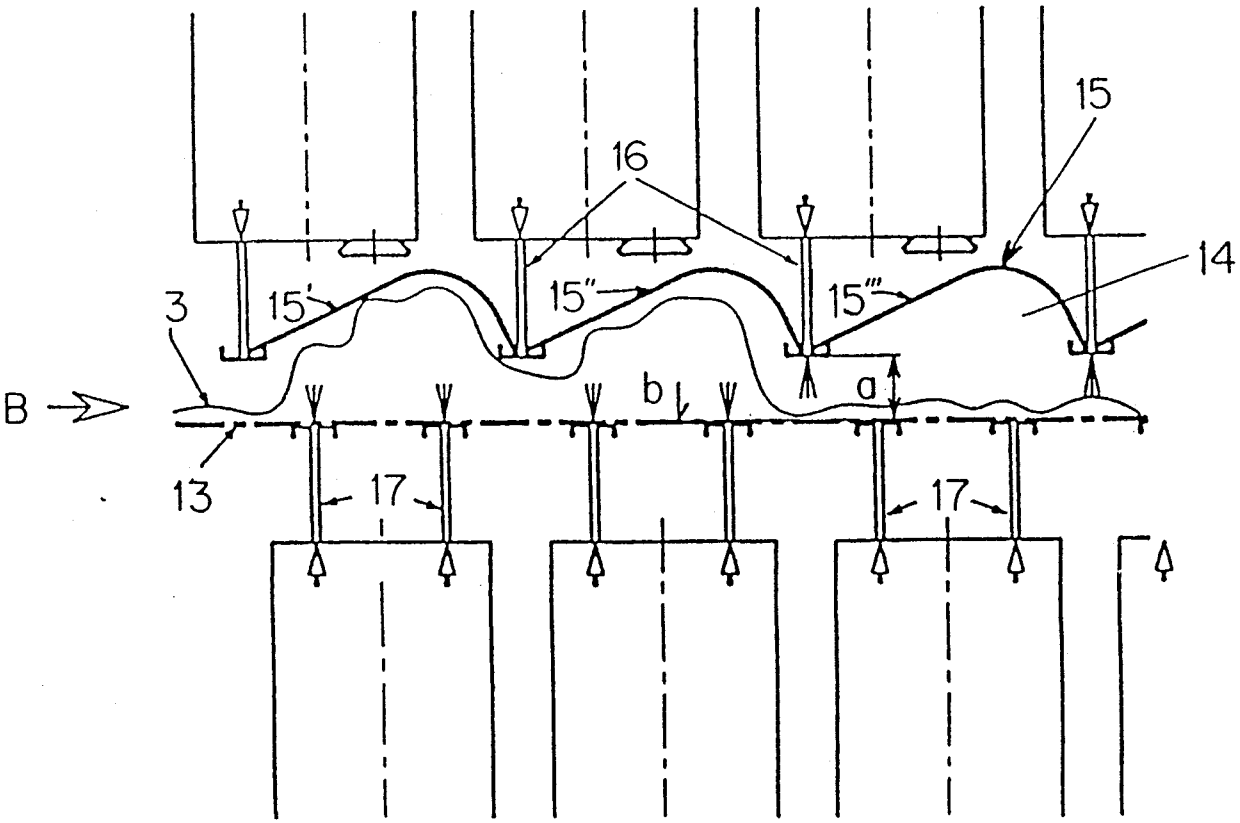
FIG. 4 shows the section A in FIG. 1, on an enlarged scale.

As can be seen in particular from FIGS. 1 and 4, the two shrink-driers 9 and 9' are provided, for receiving and transporting the material 3 to be treated through the shrink-driers and for depositing the material 3 emerging from the shrink-drier 9' into the first material web store 1, with a common continuously drivable air-permeable endlessly circulating conveyor belt 13 which is driven at a conveying speed of approximately 40 to 50 m/min. Arranged on the latter, for forming a transport channel 14 which is upwardly and downwardly delimited in the vertical direction and serves to receive and vertically support the material 3 to be treated, is an upper stationary and air-permeable delimitation wall 15 through which downwardly directed blower nozzles 16 running transversely with respect to the conveying direction of the material web pass.

To achieve as small as possible a residual shrinkage potential, the upper delimitation wall 15 which is perforated so as to be air-permeable has in a vertical section running longitudinally with respect to the direction of transport of the material web (see in particular FIG. 4) at least approximately the shape of a shed roof, there being arranged between each two mutually adjacent angular sections 15', 15'', 15''', etc. a respective downwardly directed blower nozzle 16 which at the same time is constructed to support the associated sections 15', 15'', 15''' etc.

For optimum individual adaptation of the flow conditions to the fabric to be dried, the spacing a of the upper blower nozzles 16 and thus of the upper delimitation wall 15 supported thereon with respect to the bearing surface b of the conveyor belt 13 is adjustable, for example in a range from approximately 10 to 80 mm.

As seen in a horizontal plane, between each two upper blower nozzles 16 there are provided two lower blower nozzles 17 which support the upper side of the conveyor belt 13 and are directed upwardly into the associated angular sections 15', 15'', 15''' etc. of the upper delimitation wall 15.

The lateral horizontal spacing of the upper blower nozzles 16 is approximately 190 mm and that of the lower blower nozzles 17 is approximately 95 mm.

The upper and the lower blower nozzles 16 and 17 supplying drying air are each divided into groups and can be connected to act in the manner of a pulse and alternately approximately twice per second to a hot air source 19 by way of changeover means 18. Here, the division and changeover is such that an inactive blower nozzle group is opposite each active blower nozzle group and the blower nozzle groups laterally directly adjacent to an active blower nozzle group are inactive. In this way, it is ensured that alternately one section of the material 3 passing through a shrink-drier 9 or 9' is always pressed down by upper blower nozzles 16 onto the bearing surface b of the endlessly circulating conveyor belt 13 and is thus necessarily conveyed together therewith through the corresponding shrink-drier 9 or 9'.

The alternating action in the manner of a pulse on the material moved through the shrink-drier from below and from above with hot air pulses, the fluttering movement effected thereby of the material 3 in the vertical direction of the transport channel 14, and the simultaneous compressing together of the material 3 running through in the approximately angular air-permeable sections 15', 15'', 15''' etc. of the upper delimitation wall 15 bring about extremely effective drying, shrinking and relaxing of the material 3 running through.

The pre-treated material 3 emerging continuously from the second shrink-drier 9' reaches the first material web store 1 with a residual moisture of preferably less than 20%, but at least 6%, and is stored there in the loose state in sections. As has already been mentioned, the material web 3 is removed pneumatically from the latter in sections with the aid of the nozzle arrangement 6, is accelerated in the acceleration channel 5 to a speed of approximately 600 to 800 m/min., depending on the type of material, and is hurled at the end of this acceleration section 5 against the impact surface 4, which is of grid-type construction and curved, and compressed there. As a result of the grid-type and thus air-permeable construction of the impact surface 4, the possibility of an air cushion damping the impact being formed between the impacting material web section and the impact surface 4 is eliminated.

Then, the same procedure is repeated with the aid of the nozzle arrangement 6' acting with the opposite conveying action from the second material web store 2 by way of the impact surface 4' to the second material web store 1, but with a smaller length advance of the material web, these to-and-fro movements are repeated alternately, and the difference in advance occurring here between these length sections of material web moved to and fro is guided away continuously from the second material web store 2 to the downstream second shrink-drier 10 for final treatment. Then, the same treatment steps are repeated in a following, analogous component 8'.

In order to be able to accelerate both light and heavy material through the acceleration channel 5 without problems, the two pneumatic conveying means groups 6, 6' have blower nozzles, which are arranged on either side of the acceleration channel 5, are alternately offset with respect to one another by the spacing$^x$ and are directed obliquely with respect to the plane of transport of the material web by the angle y, as a result of which the material 3 to be transported through the acceleration channel 5 against the impact surface 4 is given the shape of a wave in the region of the active blower nozzle group 6 (right-hand side of FIG. 3), as a result of which the transporting air acts extremely efficiently on the material 3 to be transported in this region and has a very good transporting action thereon.

Since the two blower nozzle groups 6, 6' are arranged in the respective end region of the acceleration channel 5, as seen in the direction of transport, any compression and clogging of the material 3 as it is transported through the acceleration channel 5 as a result of the tensile force acting on the material 3 to be transported in this way is completely eliminated.

Depending on the type of material 3, it can also be advantageous to supply saturated steam to the nozzle arrangement 6 and/or 6' during its use, in order to subject the material 3 running through additionally also to a saturated steam treatment, before it enters the second shrink-drier 10, to obtain even greater and more even shrinkage.

Depending on the type of material 3 and the desired degree of treatment, it can in some circumstances be advantageous to arrange one or more shrink-driers similar to the shrink-driers 9 and 9' downstream of the last component 8'.

I claim:

1. A method for continuously shrinking textile fabrics, in particular a textile hosiery material web, said method comprising the steps of:

placing said material web, in a loose state, onto an endlessly circulating material web bearing surface;

advancing said material web abruptly by means of first and second blower nozzles, said first blower nozzle blowing said material web toward said material web bearing surface, said second blower nozzle blowing said material web away from said material web bearing surface and towards an air-permeable material web compression surface, said material web bearing surface defining and said web compression surface defining a transport channel in which said material web is advanced; and drying said material web in said transport channel by very abruptly alternating the movement of said material web, up and down, by said first and second blower nozzles by contactlessly supporting said material web above said material web bearing surface while in said transport channel.

2. The method recited in claim 1, wherein said second step of advancing is carried out by providing groups of upper and lower blower nozzles, said upper groups of blower nozzles arranged so as to be opposite a next nearest neighbor, in relation to the material web advancing direction, said groups of lower blower nozzles arranged to correspond to said upper groups of blower nozzles in a mutually opposing fashion.

3. The method recited in claims 2, wherein said upper and lower groups of blower nozzles are actuated in alternate half cycles.

4. The method recited in claim 3, wherein said alternating half cycles provide for two changeovers per second which is equivalent to each half cycle having a duration of approximately ¼ of a second.

5. The method recite in claim 1, wherein said material web bearing surface is advanced at a speed in the range of 40 to 50 m/min.

6. The method recited in claim 1, wherein said material web is advanced at a speed in the range of 600 to 800 m/min.

7. The method recited in claim 1, further comprising the steps of:

supplying said material web before said placing step from a first material web store;

compressing said material web against a first impact surface after said drying step; and collecting said material web in a second material web store.

8. The method recited in claim 7, further comprising the step of alternating the direction of material web flow so as to supply said material web from said second material web store, compress said material web against a second impact surface, and collect said material web in said first material web store.

9. The method recited in claim 8, wherein said alternating step further comprises the steps of:

actuating said upper and lower groups of blower nozzles in alternate half cycles;

advancing said web bearing surface at a speed in the range of 40 to 50 m/min; and advancing said material web at a speed in the range of 600 to 800 m/min.

10. The method recited in claim 7, wherein said material web is hurled against a respective impact surface at a speed in the range of 600 to 800 m/min.

11. The method recited in claim 7, further comprising the steps of:

temporarily storing said material web in a first U-shaped material web store, before said step of placing, said web material being introduced continuously into a first leg of said first U-shaped material web store and being removed continuously, alternately and in sections from a second leg of said first U-shaped material web store;

temporarily storing said material web in a first leg of a second U-shaped material web store, after said step of drying;

transporting said web in a reciprocal fashion between said second leg of said first U-shaped material web store and said first leg of said second U-shaped material web store; and removing said material web from a second leg of said second U-shaped material web store.

12. The method recited in claim 7, wherein said blower nozzles are laterally offset with respect to one another, are directed obliquely with respect to the plane of said material web bearing surface and are arranged directly in front of said impact surface.

13. The method recited in claim 7, wherein said material web has a residual moisture of at most 20% upon entry of said first material web store.

14. The method recited in claim 1, further comprising the step of treating said material web with saturated steam during said advancing step.

15. An apparatus for continuously shrinking textile fabrics, in particular a textile hosiery material web, said apparatus comprising:

a air-permeable endlessly circulating material web bearing surface;

an upper stationary and air permeable delimiting wall, said material web bearing surface and said delimiting wall defining a transport channel;

at least one upper blower nozzle, said blower nozzle orientated downwardly and running transversely with respect to the direction of said material web bearing surface;

at least one lower blower nozzle arranged in a direction in which said material web is moved and said lower nozzle offset with respect to said upper blower nozzle; and said upper and lower blower nozzles arranged with respect to each other to very abruptly alternate the movement of said material web, up and down and to contactlessly support said material web above said material web bearing surface while in said transport channel.

16. The apparatus recited in claim 15, wherein said air-permeable delimination wall has approximately the shape of a wave, as seen in a vertical section running longitudinally with respect to the transport direction of said material web.

17. The apparatus recited in claim 16, wherein said air-permeable delimination wall is formed from a plurality of directly successive wall sections which extend transversely with respect to the direction of said material web bearing surface and which have at least an approximately angular cross-section and between which there is disposed one of said upper blower nozzles.

18. The apparatus recited in claim 15, wherein said upper and lower blower nozzles are divided into groups and are connected to an air circulating means by way of a changeover means, this changeover being such that an inactive blower nozzle group is opposite an active blower nozzle group, said changeover taking place in the manner of a pulse.

19. The apparatus recited in claim 15, wherein a vertical spacing between said upper or lower blower and a next adjacent blower is adjustable between a range of 10 to 80 mm.

20. The apparatus recited in claim 15, wherein a lateral spacing between said upper blower and a next adjacent blower is approximately 190 mm.

21. The apparatus recited in claim 15, wherein the lateral spacing between said lower blower and a next adjacent blower is approximately 95 mm.

22. An apparatus for continuously shrinking textile fabrics, in particular a textile hosiery material web, said apparatus comprising:

two material web stores, one disposed at either end of an acceleration channel;

two material web impact surfaces, each associated with a respective said material web store;

a supply arrangement for continuously supplying said material web into said first material store;

a removal arrangement for continuously guiding away said material web from said second material web store; and pneumatic conveying means which are associated with said acceleration channel, and are actuated so that said conveying means is changed over in two mutually opposed longitudinal directions of said acceleration channel, for alternately conveying said material web in mutually opposed longitudinal directions in said acceleration channel, said conveying means also for contactlessly supporting said material web in said acceleration channel.

23. The apparatus recited in claim 22, wherein said material web stores are constructed to be approximately U-shaped, each U-shaped member having a first leg and a second leg; said U-shaped members for temporarily storing said material web in said first U-shaped material web store, said web materials being introduced continuously into said first leg of said first U-shaped material web store and being removed continuously, alternately and in sections from said second leg of said first U-shaped material web store; and for temporarily storing said material web in said first leg of said second U-shaped material web store; said material web stores designed to assist in the transporting said web in a reciprocal fashion between said second leg of said first U-shaped material web store and said first leg of said second U-shaped material web store; and finally, for removing said material web from said second leg of said second U-shaped material web store.

24. The apparatus recited in claim 22, wherein said material web stores further comprise an optical sensor means for sensing the level of filling within said material web stores.

25. The apparatus recited in claim 22, wherein said pneumatic conveying means comprises two pneumatically conveying means groups acting in two mutually opposed directions of said acceleration channel, said two groups connected to a compressed air source, alternating separately from one another, by way of a change-over element operating in accordance with the Coanda effect principle, said two groups comprising blower nozzles which are disposed on both sides of said acceleration channel, are alternately laterally offset with respect to one another and directed obliquely with respect to a direction motion of said material web, and said two groups being disposed in an end region of said acceleration channel.

26. The apparatus recited in claim 22, wherein said supply and removal arrangements are constructed to be regulable independently of one another's transporting speeds.

27. The apparatus recited in claim 22, wherein said material web impact surface has a grid-type structure and are constructed to be outwardly and downwardly curved for compressively receiving said material web when hurled thereagainst.

28. The apparatus recited in claim 22, further comprising a plurality of processing units connected in series, each processing unit comprising:

two material web stores, one disposed at either end of an acceleration channel;

two material web impact surfaces, each associated with a respective said material web store;

a supply arrangement for continuously supplying said material web into said first material store;

a removal arrangement for continuously guiding away said material web from said second material web store; and pneumatic conveying means which are associated with said acceleration channel, and are actuated so that said conveying means is changed over in two mutually opposed longitudinal directions of said acceleration channel, for alternately conveying said material web in mutually opposed longitudinal directions in said acceleration channel, said conveying means also for contactlessly supporting said material web in said acceleration channel.

29. The apparatus recited in claim 22, further comprising at least one shrink-drier arranged upstream of said first material web store or at least one shrink-drier arranged downstream of said second material web store.

30. An apparatus for continuously shrinking textile fabrics, in particular a textile hosiery material web, said apparatus comprising:

two material web stores, one disposed at either end of an acceleration channel;

two material web impact surfaces, each associated with a respective said material web store, wherein at least one of said material impact surfaces having a grid-type structure and are constructed to be outwardly and downwardly curved for compressively receiving said material web when hurled thereagainst;

a supply arrangement for continuously supplying said material web into said first material store;

a removal arrangement for continuously guiding away said material web from said second material web store; and pneumatic conveying means which are associated with said acceleration channel, and are actuated so that said conveying means is changed over in two mutually opposed longitudinal directions of said acceleration channel, for alternately conveying said material web in mutually opposed longitudinal directions in said acceleration channel.

31. An apparatus for continuously shrinking textile fabrics, in particular a textile hosiery material web, said apparatus comprising:

two material web stores, one disposed at either end of an acceleration channel;

two material web impact surfaces, each associated with a respective said material web store;

a supply arrangement for continuously supplying said material web into said first material store;

a removal arrangement for continuously guiding away said material web from said second material web store;

pneumatic conveying means which are associated with said acceleration channel, and are actuated so that said conveying means is changed over in two mutually opposed longitudinal directions of said acceleration channel, for alternately conveying said material web in mutually opposed longitudinal directions in said acceleration channel; and at least one shrink-drier arranged upstream of said first material web store or at least one shrink-drier arranged downstream of said second material web store.

32. A method for continuously shrinking textile fabrics, in particular a textile hosiery material web, said method comprising the steps of:

supplying said material web from a first material web store, said material web having a residual moisture of at most 20% upon entry of said first material web store;

placing said material web, in a loose state, onto an endlessly circulating material web bearing surface;

advancing said material web abruptly by means of a first and second blower nozzles, said first blower nozzle blowing said material web toward said material web bearing surface, said second blower nozzle blowing said material web away from said material web bearing surface and towards an air-permeable material web compression surface, said material web bearing surface defining and said web compression surface defining a transport channel in which said material web is advanced;

drying said material web in said transport channel by very abruptly alternating the movement of said material web, up and down, by said first and second blower nozzles;

alternating the direction of travel of said material web in order to encourage further shrinking;

compressing said material web against a first impact surface disposed at one end of said transport channel; and collecting said material web in a second material web store.

33. A method for continuously shrinking textile fabrics, in particular a textile hosiery material web, said method comprising the steps of:

supplying said material web from a first material web store;

placing said material web, in a loose state, onto an endlessly circulating material web bearing surface;

advancing said material web abruptly by means of a first and second blower nozzles, said first blower nozzle blowing said material web toward said material web bearing surface, said second blower nozzle blowing said material web away from said material web bearing surface and towards and air-permeable material web compression surface, said material web bearing surface defining and said web compression surface defining a transport channel in which said material web is advanced;

treating said material web with saturated steam;

drying said material web in said transport channel by very abruptly alternating the movement of said material web, up and down, by said first and second blower nozzles;

alternating the direction of travel of said material web in order to encourage further shrinking;

compressing said material web against a first impact surface disposed at one end of said transport channel; and collecting said material web in a second material web store.

* * * * *